US006954954B2

(12) United States Patent
Stelnicki

(10) Patent No.: US 6,954,954 B2
(45) Date of Patent: Oct. 18, 2005

(54) INFANT SLEEP GUARD SYSTEM AND METHOD

(75) Inventor: Eric Jason Stelnicki, Fort Lauderdale, FL (US)

(73) Assignee: Pediatric Medical Solutions, LLC, Fort Lauderdale, FL (US)

( * ) Notice: Subject to any disclaimer, the term of this patent is extended or adjusted under 35 U.S.C. 154(b) by 0 days.

(21) Appl. No.: 10/360,054

(22) Filed: Feb. 6, 2003

(65) Prior Publication Data

US 2003/0145384 A1 Aug. 7, 2003

Related U.S. Application Data

(60) Provisional application No. 60/354,750, filed on Feb. 6, 2002.

(51) Int. Cl.[7] ..... A47D 13/08
(52) U.S. Cl. ..... 5/655; 5/657
(58) Field of Search ..... 5/655, 652, 657, 5/640, 630, 632

(56) References Cited

U.S. PATENT DOCUMENTS

| | | | | |
|---|---|---|---|---|
| 2,367,459 | A | | 1/1945 | Corley |
| 2,405,326 | A | | 8/1946 | Plotsky |
| 3,005,203 | A | | 10/1961 | Alieo et al. |
| 3,588,914 | A | | 6/1971 | Ihnat, Jr. |
| 3,784,984 | A | | 1/1974 | Aileo |
| 3,786,519 | A | | 1/1974 | Aileo |
| 3,924,282 | A | | 12/1975 | Bond |
| 4,646,367 | A | | 3/1987 | El Hassen |
| 4,679,263 | A | | 7/1987 | Honer |
| 4,776,324 | A | | 10/1988 | Clarren |
| 4,805,239 | A | | 2/1989 | Ciago |
| 5,038,412 | A | | 8/1991 | Cionni |
| 5,189,748 | A | | 3/1993 | Garrison et al. |
| 5,216,772 | A | | 6/1993 | Clute |
| 5,272,780 | A | | 12/1993 | Clute |
| 5,341,531 | A | | 8/1994 | Straub et al. |
| 5,359,739 | A | | 11/1994 | Rains et al. |
| 5,367,730 | A | | 11/1994 | Sher |
| 5,450,640 | A | | 9/1995 | Patton et al. |
| 5,499,418 | A | | 3/1996 | Tan et al. |
| 5,524,640 | A | * | 6/1996 | Lisak et al. ..... 5/655 |
| 5,530,974 | A | | 7/1996 | Rains et al. |
| 5,581,832 | A | | 12/1996 | Bridley |
| 5,675,840 | A | | 10/1997 | Clavelle |
| RE36,583 | E | | 2/2000 | Pomatto et al. |
| 6,052,849 | A | | 4/2000 | Dixon et al. |
| 6,266,832 | B1 | | 7/2001 | Ezell |
| 6,381,787 | B1 | | 5/2002 | Rogone et al. |
| 6,438,761 | B1 | | 8/2002 | McGarrity |
| 6,473,923 | B1 | | 11/2002 | Straub |
| 2002/0042954 | A1 | | 4/2002 | Straub |

* cited by examiner

*Primary Examiner*—Michael Safavi
(74) *Attorney, Agent, or Firm*—Christopher & Weisberg, P.A.

(57) ABSTRACT

An infant positioning system and method for positioning an infant during sleep. The infant positioning system includes and infant support device and a headgear. The infant support device is configured for receiving the infant, and selectively changing the position of the infant each night. The headgear is configured to fit about the head of the infant, dispersing the pressure a sleeping surface places on the head of the infant.

8 Claims, 6 Drawing Sheets

INFANT SLEEP GUARD SYSTEM AND METHOD

CROSS-REFERENCE TO RELATED APPLICATION

This application is related to and claims priority to U.S. Provisional Patent Application Ser. No. 60/354,750, filed Feb. 6, 2002, entitled SLEEP GUARD INFANT PROTECTION SYSTEM FOR PREVENTION AND TREATMENT OF DEFORMATIONAL PLAGIOCEPHALY, TORTICOLLIS, AND TO DECREASE THE RISK OF SIDS, the entirety of which is incorporated herein by reference.

STATEMENT REGARDING FEDERALLY SPONSORED RESEARCH OR DEVELOPMENT n/a

FIELD OF THE INVENTION

The present invention relates to a method and system for supporting an infant, and more particularly to a method and device for selectively positioning an infant during sleep.

BACKGROUND OF THE INVENTION

Studies have shown that infants sleeping on their stomachs have an increased risk of the occurrence of Sudden Infant Death Syndrome, commonly referred to as SIDS, than do infants sleeping on their backs. While there is no definitive diagnosis of the cause of SIDS, it remains a serious problem with no known cure. Some theorize the infants simply suffocate possibly due to their not having enough strength to raise their heads off the mattress when in a prone position in order to avoid whatever obstacle is blocking their breathing. SIDS is more prevalent in the first six months of the infant's life, which adds support to the theory that the infant's underdeveloped motor skills may be a factor in SIDS deaths. Since 1992, the American Pediatric Association has recommended that all children sleep on their backs instead of the stomachs. As a result, parents have increasingly positioned their infants on their backs for sleeping.

Although important in decreasing the occurrence of SIDs, an unfortunate consequence of the increasingly widespread practice of placing infants on their backs for sleeping has been an increase in the number of infants developing deformational plagiocephaly. Deformational plagiocephaly is a warping of the infant's head due to external forces. A newborn infant's skull is relatively deformable due to flexibility of the bone plates and non-fusion of the sutures between adjacent bone plates. When an infant spends many hours daily sleeping exclusively on its back, the bones at the back of the skull tend to flatten from pressure against the sleeping surface due to the weight of the child's head. If the practice of sleeping exclusively on the back is continued through the critical period during which the bones of the skull become rigid, the flat or misshapen area on the back of the skull can become permanent.

It is therefore be desirable to provide a device for positioning an infant during sleep which reducing the risk of an occurrence of SIDS, but that also reduces the risk of the infant developing deformational plagiocephaly.

SUMMARY OF THE INVENTION

The subject invention provides an infant positioning system and method for positioning an infant during sleep. The infant positioning system includes and infant support device and a headgear. The infant support device is configured for receiving the infant, and selectively changing the position of the infant each night. The headgear is configured to fit about the head of the infant, dispersing the pressure at sleeping surface places on the head of the infant.

The infant support includes a base member and an abdominal support member attachable to the base member. A plurality of back support members are included, each being selectively attachable to the base member in an opposing arrangement with the abdominal support member. Each of the plurality of back support members is configured to support the infant in a different position.

The headgear includes support pads, which are positioned between the head of the infant and the sleeping surface. The support pads substantially, evenly disperse the pressure the sleeping surface imparts on the head of the infant during sleep.

In use, the infant is positioned within the infant support where that stomach and chest of the infant are positioned against the abdominal support member, and the back of the infant is supported by the back support member. Each night a different back support member is used, such that the body and head of the infant are in a different position, altering the pressure point on the head of the infant. The headgear is placed on the head of the infant, such that the support pad is positioned between the head of the infant and the sleeping surface, evenly disperse the pressure on the head of the infant.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The subject invention provides an infant positioning system and method for positioning an infant during sleep. The infant positioning system includes an infant support configured for controllably positioning and supporting the body of the infant. The infant support changes the position of the body and head of the infant each night, thereby changing the pressure point between the head of the infant and the crib or other support platform.

Figure 1:
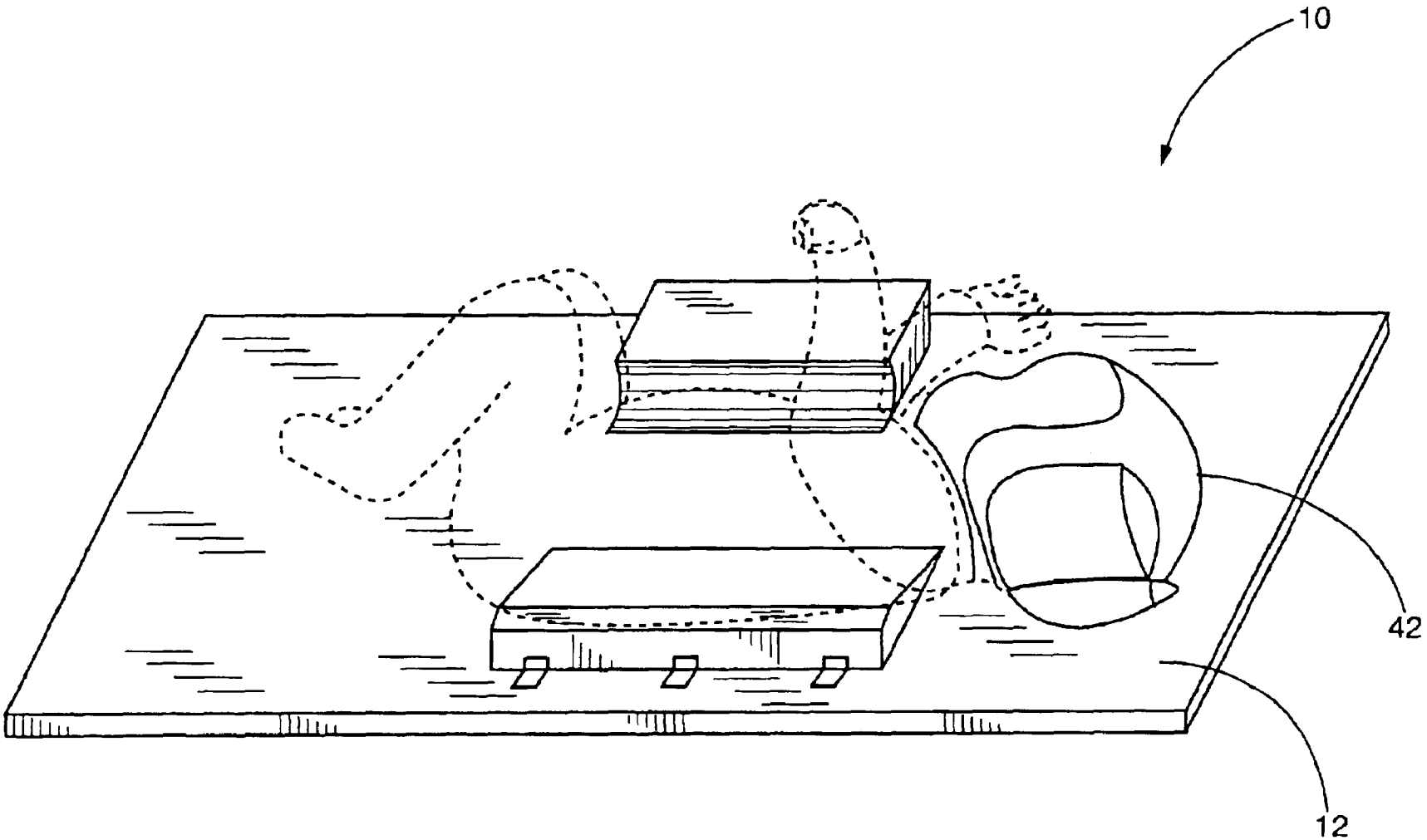
FIG. 1 is a perspective view of the infant positioning system of the subject invention.

Referring to the drawing figures in which like reference designations refer to like elements, there is shown in FIG. 1 an infant positioning system 10 constructed according to the present invention. The infant positioning system includes an infant support 12 and a headgear 42. The infant support 12 is configured to position the body and head of the infant in a different position each night, altering the pressure point on the head of the infant. The headgear 42 is configured to fit about the head of an infant, substantially evenly dispersing the pressure the sleeping surface imparts on the head of the infant.

Figure 2:
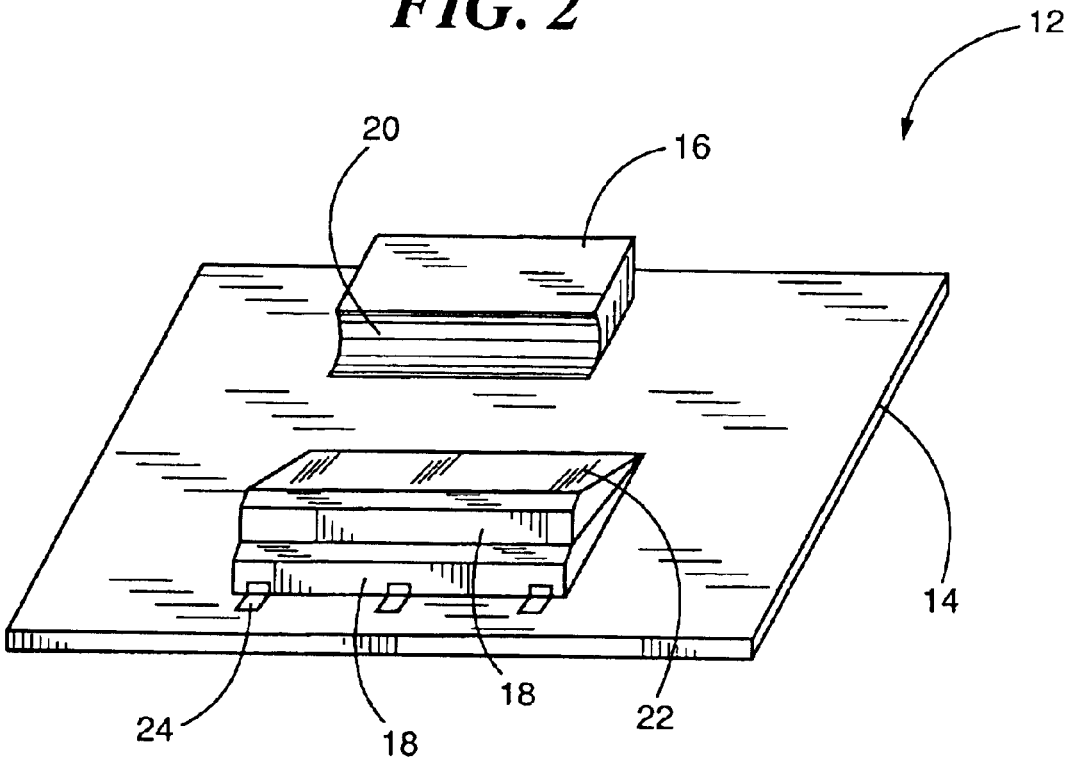
FIG. 2 is a perspective view of the infant support device of the of the subject invention.

Referring to FIG. 2, the infant support 12 includes a base member 14 having a pair of opposing support members positioned thereon. The opposing support members include an abdominal support member 16 and a back support member 18 each being removably attached to the base member 14 in a spaced-apart relation. The abdominal support member 16 and back support member 18 are positioned such that an infant can be place between the abdominal support member 16 and back support member 18. The abdominal support member 16 supports the stomach and chest of the infant, and the back support member 18 supports the back of the infant. The distance between the abdominal support member 16 and back support member 18 can be increased or decreased to accommodate different size infants.

The base member 14 can be substantially rectangular in shape, being made of a woven or non-woven fabric. For example, the base member 14 can be made of a cotton terry cloth fabric, a resilient material such as foam or memory foam material, or a resilient material covered with a cotton terry cloth fabric. Alternatively, the base member 14 can be circular or elliptical in shape.

Figure 3:
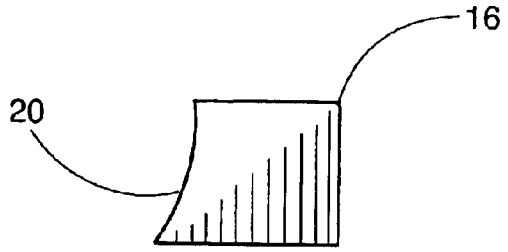
FIG. 3 is side view of the abdominal support member of the infant support device.

The abdominal support member 16 is configured to support the stomach and chest of the infant, having a front surface 20 sized to prevent the infant from rolling over onto its stomach. For example, as shown in FIG. 3, the front surface 20 of the abdominal support member 16 is configured to the support the stomach and chest of the infant substantially perpendicular to the base member 14, where the front surface 20 is substantially concave, being molded to fit against the chest and abdomen of the infant.

Figure 4:
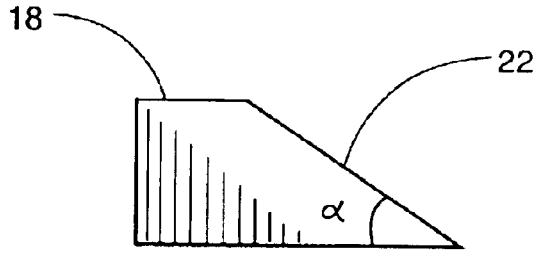
FIG. 4 is side view of the back support member of the infant support device.

The back support member 18 is configured to support the back of the infant, having a front surface 22 sized to prevent the infant from rolling over onto its back. For example, as shown in FIG. 4 the front surface 22 of the back support member 18 is at an angle $\alpha$ to the base member 14, where the angle $\alpha$ is sufficiently large to prevent the infant from rolling onto its back. The infant support 12 can includes a set of back support members, where the angle $\alpha$ of the individual back support members 18 are each configured to place the body of the infant in a different position during sleep.

For example, the set of back support members can include back support members 18 having an angle $\alpha$ substantially equal to 30°, 60°, and 90°. The noted angles are only exemplary, and other sets of angles for the individual back support members 18 are envisioned which place the body and head of the infant are in a different position each night, altering the pressure point on the head of the infant.

Alternatively, the back support members 18 can be stackably arranged, such that the angle $\alpha$ can be increased or decreased by adding or removing back support members 18. For example, each of the back support members 18 can have an angle substantially equal to 30°, such that the angle $\alpha$ can be incrementally increased to from 30° to 60° and to 90°, or incrementally decreased to from 90° to 60° and to 30°.

The abdominal support member 16 and back support member 18 can be formed from a firm foam material, sufficiently stiff to support the infant. Alternatively, the abdominal support member 16 and back support member 18 can be made from a resilient, elastomeric, and shape retaining material, where the support member has sufficient stiffness to support the infant.

Figure 5:
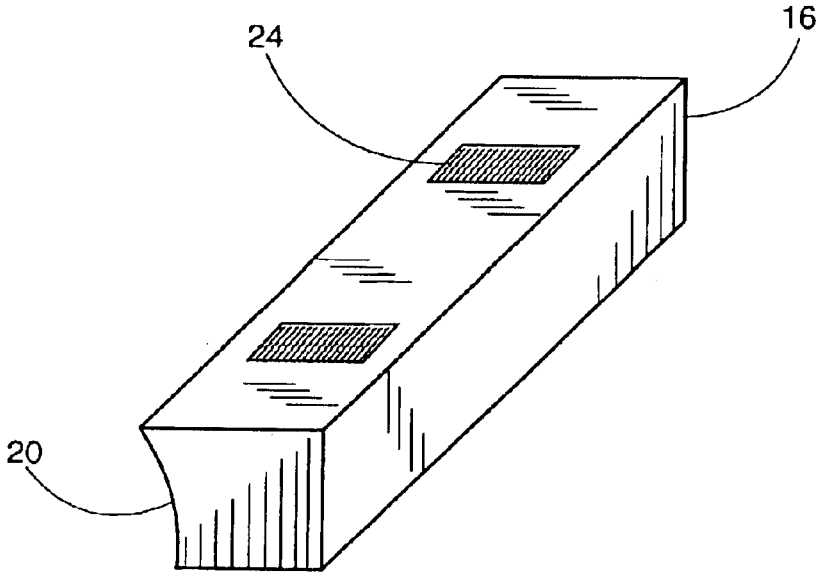
FIG. 5 is bottom view of the abdominal support member of the infant support device.

As shown in FIGS. 2 and 5, the abdominal support member 16 and back support member 18 are removably attached to the base member 14 by hook and loop fasteners. Hook and loop fastener strips 24 are attached to base member 14 in the desired location for abdominal support, with corresponding hook and loop fastener strips 24 being attached to the bottom surface of abdominal support member 16. The abdominal support member 16 is releasably attachable to the base member 14 by means of the mutual engagement of hook and loop fastener strips 24 on the base member 14 and the abdominal support member 16. Similarly, hook and loop fastener strips 24 are attached to the bottom surface of the back support member 18, with hook and loop fastener strips 24 being attached to the base member 14 in the desired location for attachment of the back support 18. Additionally, the abdominal support member 16 and back support member 18 can be attached to the base member 14 by other means known in the art, including but not limited to, snaps. buttons, or elastic, straps.

Figure 6:
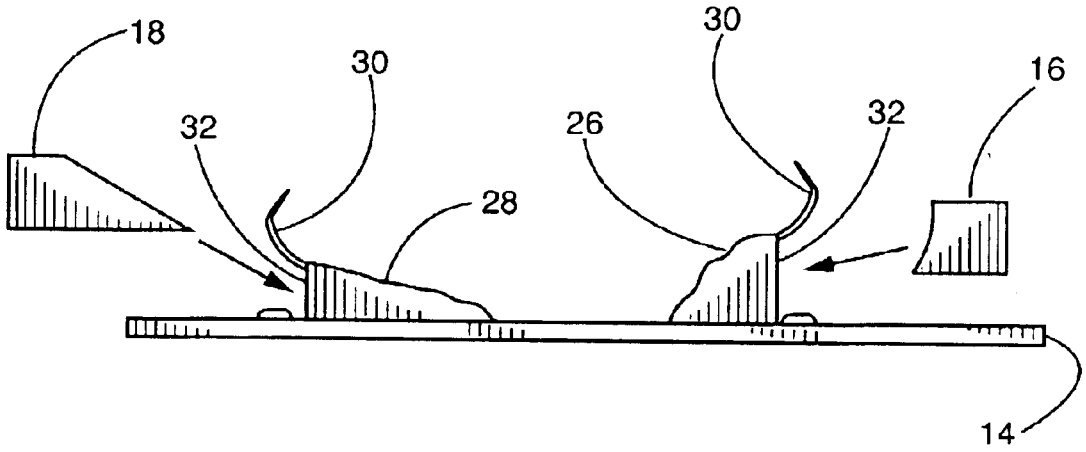
FIG. 6 is a side exploded view of the infant support device including integrated pockets.

Alternatively, as shown in FIG. 6, the base member 14 can include a pair of opposing pockets 26 and 28, each defining an interior surface. The abdominal support member 16 and back support member 18 are insertable into the opposing pockets 26 and 28 and can be secured therein. For example, flaps 30 can be attached to the pockets 26 and 28 which are closable over the pocket openings 32. The flaps 30 are attachable to the base member 14, securing abdominal support member 16 and back support member 18 within the pockets 26 and 28.

Figure 7:
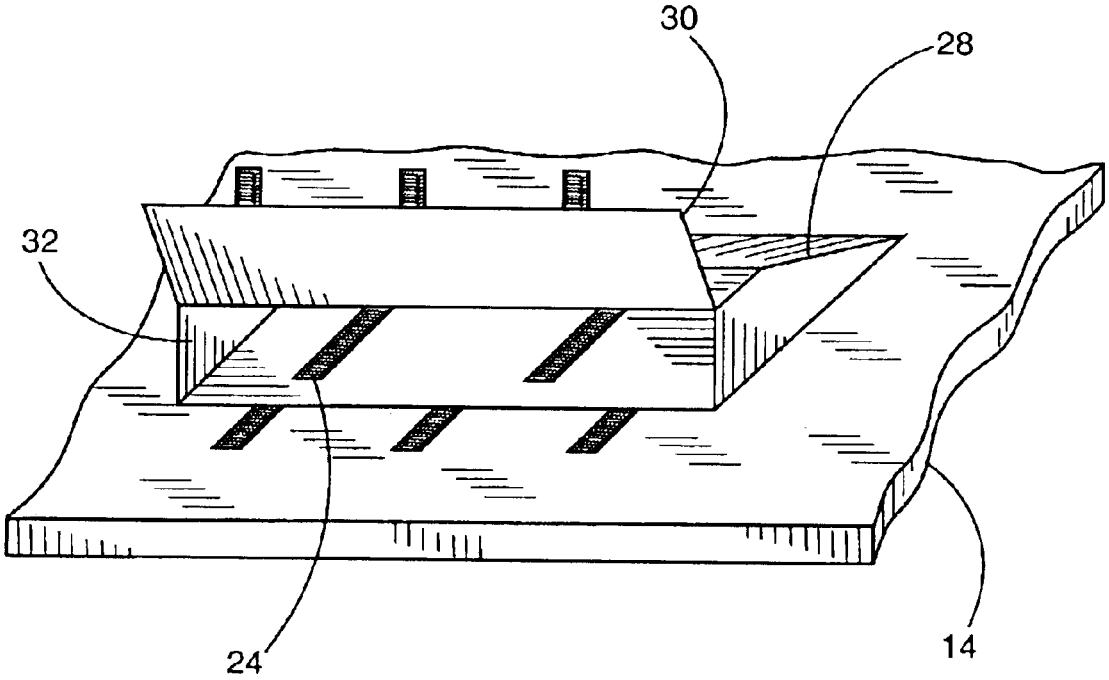
FIG. 7 is a rear sectional view of the infant support device showing an integrated pocket.

Alternatively, as shown in FIGS. 6 and 7, the abdominal support member 16 and back support member 18 can be removably secured within the pockets 26 and 28 by means of hook and loop fastener strips 24, where the hook and loop fastener strips 24 are attached to base member 14 within the interior of the pockets 26 and 28 and to the bottom side of the abdominal support member 16 and back support member 18. The opposing pockets 26 and 28 can be made of a woven or non-woven elastic fabric, which will conform to the support members 16 and 18.

In use, the infant support 12 is placed in a crib. The abdominal support member 16 and back support member 18 are attached to the base member 14, where the abdominal support member 16 and back support member 18 are sufficiently spaced-apart to support an infant. The abdominal support member 16 and back support member 18 are spaced apart such that stomach and chest of the infant is positionable against the abdominal support member 16, the back of the infant being supported by the back support member 18. The infant is positioned with the infant support 12 such that the head and face of the infant are clear of the abdominal support member 16. Each night a different back support member 18 is used, such that the body and head of the infant are in a different position, altering the pressure point on the head of the infant. Additionally, the infant can be rotated, being positioned to sleep on its right site for a set number of night, and on its left side for a set number of nights.

For example, the set of back support members can include three different back support members 18, where the infant can be positioned as scheduled:

Night 1: First back support member with right side down;

Night 2: Second back support member with right side down;

Night 3: Third back support member with right side down;

Night 4: No back support member, infant on back;

Night 5: First back support member with left side down;

Night 6: Second back support member with left side down; and

Night 7: Third back support member with left side down. The positioning schedule is configured such that the infant is placed in a different position each night of the schedule. The schedule is continually repeated until the infant is of a sufficient age as it in not longer needed. The noted sleep schedule is only exemplary, and other sleep schedules are envisioned which place the body and head of the infant in a different position each night, rotating the pressure on the head of the infant.

The infant positioning system further includes a headgear configured to fit about the head of an infant, where the headgear positions support pads about the head of the infant. The support pads are positioned to evenly disperse the pressure the sleeping surface imparts on the head of the infant during sleep. Additionally, the support pads can be used to raise the head of the infant, properly aligning the head and body of the infant, decreasing the stress on the neck of the infant.

Figure 8:
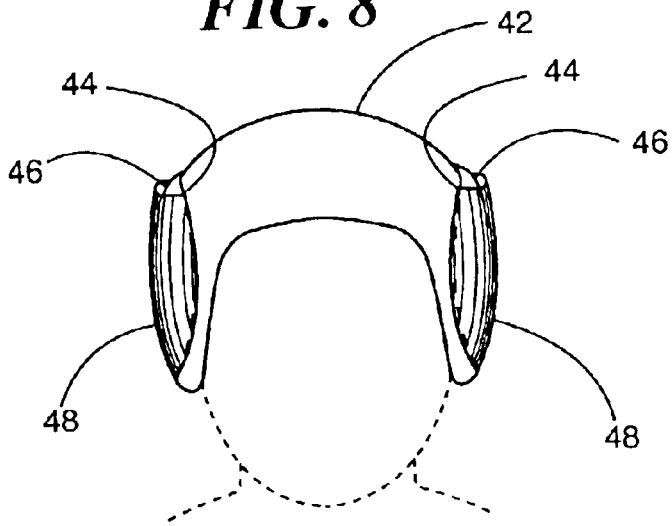
FIG. 8 is front view of the headgear of the subject invention.

Referring to FIG. 8, the headgear 42 is configured to be placed about the head of an infant. The headgear 42 includes a pair of side panels 44, each configured for receiving a support pad 46. The side panels 44 are positioned on opposite sides of the headgear 42, substantially covering the sides of the head of the infant. The support pads 46 are attached to the side panels 44, being used to evenly distribute the pressure imposed on the head of the infant head during sleep. When an infant is sleeping on its side, a support pad 46 is positioned between the head of the infant and the sleeping surface. The pressure from the sleeping surface is dispersed through the support pad 46, being evenly distributed to the head of the infant over the entire surface area of the support pad 46. The headgear 42 can take the form of a mesh cap, a headband, a helmet, or other suitable device configured to fit about the head of an infant.

The side panels 44 can each include a pocket 48 configured for receiving at least one support pad 46. The support pads 46 are insertable into the pockets 48 and can be secured therein. For example, the support pads 46 can be removably secured within the pockets 48 by means of hook and loop fastener strips, where the hook and loop fastener strips are attached to side panels 44 within pockets 48 and to the back side of the support pads 46. The pockets 48 can be made of a woven or non-woven elastic fabric, which can conform about the support pad 46.

Alternatively, the support pads 46 can be removably attached to the side panels 44 by hook and loop fasteners. Hook and loop fastener strips are attached to side panels 44, with corresponding hook and loop fastener strips being attached to the back surface of support pads 46. The support pads 46 are releasably attachable to the side panels 44 by means of the mutual engagement of hook and loop fastener strips on the side panels 44 and the support pads 46. Additionally, the support pads 46 can be attached to the headgear 42 by other means known in the art, including but not limited to, snaps. button, or elastic, straps.

The support pads 46 can be used to raise the head of the infant, decreasing the stress on the neck of the infant. The support pads 46 can be stackably arranged, such that the head and body of the infant are aligned. The side panel pockets 48 can be configured for receiving more than one support pad 46. The support pads 46 are inserted into the pockets, where support pads 46 of varying thickness can be used to achieve the proper alignment of the head and body of the infant.

Alternatively, the support pads 46 can be stackable by other means known in the art, including but not limited to, hook and loop fasteners, snaps, button, or elastic, straps.

Figure 11:
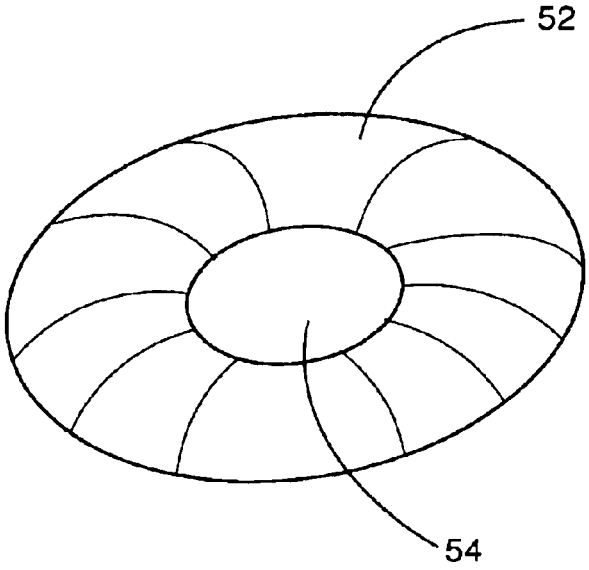
FIG. 11 is a perspective view of the rear support pad for the headgear.
Figure 9:
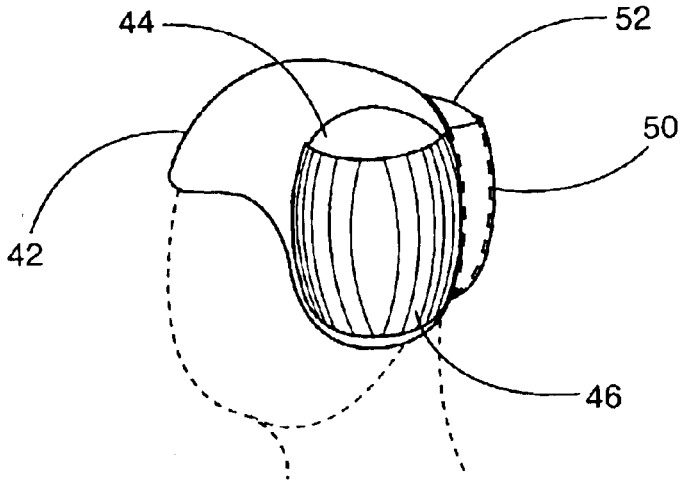
FIG. 9 is side view of the headgear of the subject invention.
Figure 10:
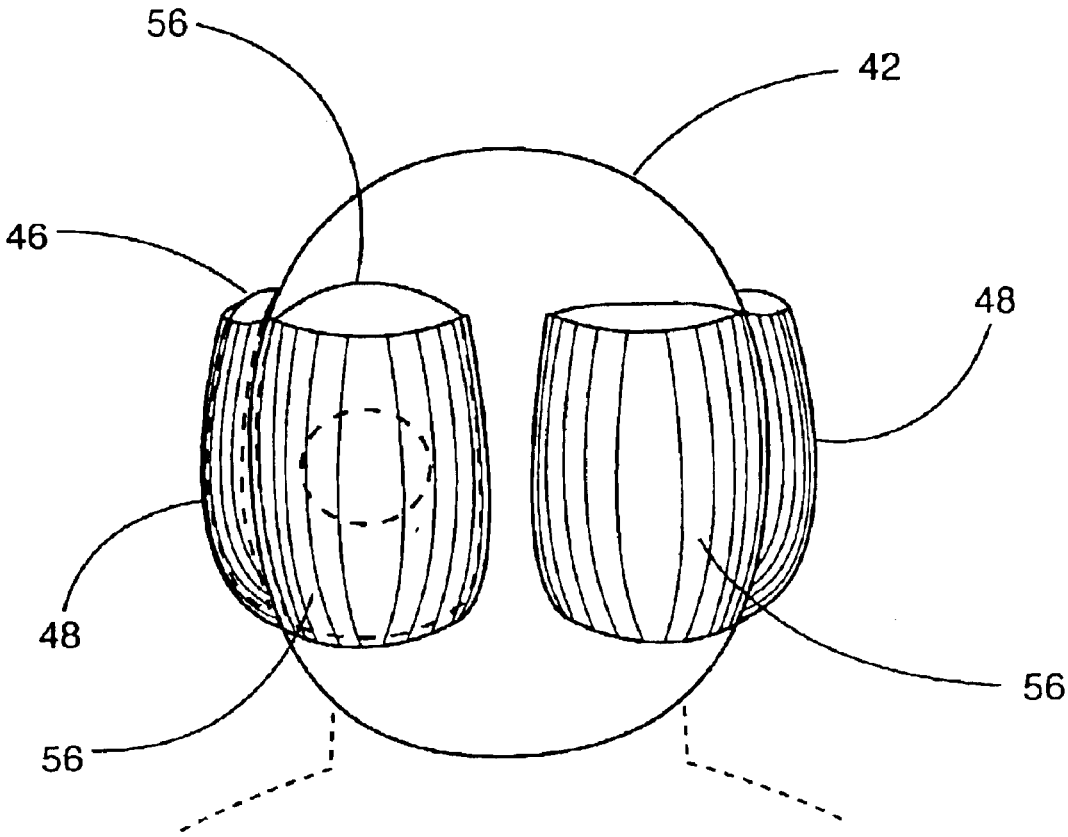
FIG. 10 is rear view of the headgear of the subject invention.

Referring to FIGS. 9 and 10, the headgear 42 further includes a pair of rear pockets 50 each being positioned tangentially to a side pocket 48 and configured for receiving a rear support pad 52. The tangential positioning of the rear pockets 50 and side pockets 48 enable the rear support pads 52 and support pads 46 to substantially cove and protect the side and rear portions of the head of the infant in contact with the sleep surface. As shown in FIG. 11, the rear support pad 52 is substantially toroidal in shape, defining a hollow center 54. Where an infant has developed deformational plagiocephaly, the rear support pad 52 is positioned on the back of the head of the infant, on either the right or left rear side, such that center 54 of the toroid overlays the flattened area. The center 54 of the toroid prevents pressure from being placed on the flattened area. Additionally, the rear support pads 52 can be attached to the headgear 42 by other means known in the art, including but not limited to, snaps, button, or elastic, straps.

Additional rear support pads 42 can be used such that the rear support pads 52 are stackably arranged. The rear support pads 52 are stacked until the contour of the contra lateral side is matched or exceeded. This prevents rolling into the flattened area, allowing growth in this region. The support pads 46 and 52 can be made from soft conforming material, including but not limited to, foam, a foam polymer material, gel, or silicone.

In use, the headgear 42 is placed about the infant head. When an infant is positioned for sleeping on its right side, at least one support pad 46 is attached to the right side of the headgear 42. Similarly, when the infant is positioned for sleeping on its left side, at least one support pad 46 is attached to the left side of the headgear 40. Additional support pads 44 can be attached to the headgear 42 in a stacking arrangement, aligning the head and body of the infant, decreasing the stress on the infant neck.

Additionally, a rear support pad 52 can be removably attached to the headgear 42, where at least one rear support pad 52 is attached to the right rear panel 50 of the headgear 42. For example, where an infant has developed deformational plagiocephaly, the rear support pad 52 is positioned on the back of the head of the infant, such that center 54 of the toroid overlays the flatten area. The center 54 of the toroid prevents pressure from being placed on the flattened area.

Figure 12:
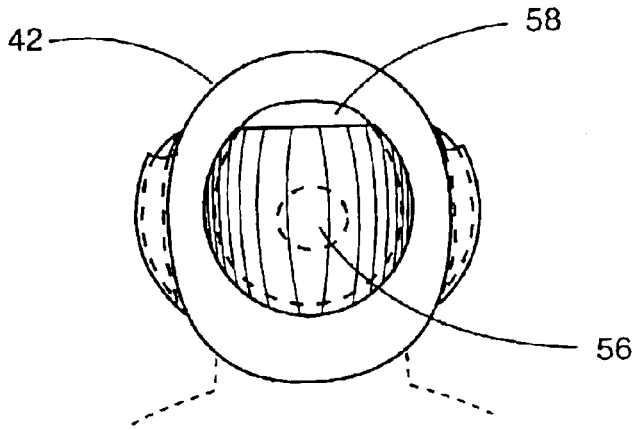
FIG. 12 is rear view of the headgear of the subject invention including a center rear support pad.

Alternatively, as shown in FIG. 12, the headgear 52 includes a center rear pocket 56, substantially centered on the back of the headgear 42, configured for receiving a center rear support pad 58. The center rear support pad 58 is substantially similar in shape to the rear support pads 52. Additionally, the center rear support pad 58 can be attached to the headgear 42 by other means known in the art, including but not limited to, snaps. button, or elastic, straps.

The infant support 12 and the headgear 42 can be used in conjunction with each other, where the infant support 12 is used to change the position of the body and head of the infant each night, altering the pressure point on the head of the infant. The headgear 42 is used to disperse the pressure from the sleeping surface, by evenly distributing the pressure to the head of the infant over the entire surface area of the support pad 46. The headgear 52 can also be used to align the head and body of the infant, decreasing the stress on the neck of the infant.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An infant positioning system for controllably positioning and supporting an infant during sleep, comprising:

an infant support device configured for receiving the infant, the infant support selectively changing the position of the infant each night, the infant support device including:

a base member;

an abdominal support member attachable to the base member; and a plurality of back support members each being selectively attachable to the base member in a substantially parallel opposing arrangement with the abdominal support member, each of the plurality of back support members being configured for selective attachment to the base member alone or in combination, to support the infant in a different position; and a headgear configured to fit about the head of the infant, the headgear dispersing a pressure a sleeping surface places on the head of the infant, wherein each of the plurality of back support members includes a front surface, each of the plurality of back support members having front surfaces at a different angle $\alpha$ to the base member from each other of the plurality of back support members, the angle $\alpha$ being between about 0° and about 90°.

2. The infant positioning system according to claim 1, wherein the plurality of back support member comprises a first back support member having an angle $\alpha$ of about 30°, a second back support member having an angle $\alpha$ of about 60°, and a third back support member having an angle $\alpha$ of about 90°.

3. An infant positioning system for controllably positioning and supporting an infant during sleep, comprising:

an infant support device configured for receiving the infant, the infant support selectively changing the position of the infant each night, the infant support device including:

a base member;

an abdominal support member attachable to the base member; and a plurality of back support members each being selectively attachable to the base member in a substantially parallel opposing arrangement with the abdominal support member, each of the plurality of back support members being configured for selective attachment to the base member alone or in combination, to support the infant in a different position; and a headgear configured to fit about the head of the infant, the headgear dispersing a pressure a sleeping surface places on the head of the infant, wherein the abdominal support member includes a front surface facing the back support member, the front surface being substantially concave.

4. The infant positioning system according to claim 3, wherein the base member comprises a pair of substantially parallel opposing pockets, the opposing pockets being configured to receive the abdominal support member and one of the plurality of back support members.

5. An infant support device for controllably positioning and supporting an infant during sleep, comprising:

a base member;

an abdominal support member attachable to the base member; and a plurality of back support members comprising a first back support member having an angle a of about 30°, a second back support member having an angle a of about 60°, and a third back support member having an angle a of about 90°, each of the plurality of back support members being selectively attachable to the base member in a substantially parallel opposing arrangement with the abdominal support member, each of the plurality of back support members being configured to support the infant in a different position, wherein the abdominal support member includes a front surface facing the back support member, the front surface being substantially concave.

6. An infant support device for controllably positioning and supporting an infant during sleep, comprising:

a base member;

an abdominal support member attachable to the base member; and a plurality of back support members each being selectively attachable to the base member in a substantially parallel opposing arrangement with the abdominal support member, each of the plurality of back support members being configured to support the infant in a different position, wherein each of the plurality of back support members includes a front surface, each of the plurality of back support members having front surfaces at a different angle $\alpha$ to the base member from each other of the plurality of back support members, the plurality of back support member comprises a first back support member having an angle a of about 30°, a second back support member having an angle a of about 60°, and a third back support member having an angle a of about 90°.

7. The infant support device according to claim 6, wherein the plurality of back support member comprises a first back support member having an angle $\alpha$ of about 30° a second back support member having an angle $\alpha$ of about 60°, and a third back support member having an angle $\alpha$ of about 90°.

8. A method for positioning an infant for sleeping, the method comprising:

a) providing an infant support device including a base member, an abdominal support member attachable to the base member, and a plurality of back support members comprising a first back support member having an angle a of about 30°, a second back support member having an angle a of about 60°, and a third back support member having an angle a of about 90°, each of the plurality of back support members being attachable to the base member in a substantially parallel opposing arrangement with the abdominal support member, each of the plurality of back support members being configured to support the infant in a different position;

b) selecting a back support member from the plurality of back support members;

c) attaching the selected back support member to the base member;

d) positioning the infant between the abdominal support member and the selected back support member, the abdominal support member being in contact with the abdomen and chest of the infant and the selected back support member being in contact with the back of the infant; and f) repeating the steps b) thru e) for each consecutive night, wherein a different back support member from the previous night's back support member is selected from the plurality of back support members.

* * * * *